United States Patent [19]

Farr et al.

[11] Patent Number: 4,499,733

[45] Date of Patent: Feb. 19, 1985

[54] EMERGENCY SHUTDOWN MECHANISM FOR A TURBOCHARGED DIESEL ENGINE

[75] Inventors: Richard S. Farr, Los Angeles; John J. Dorn, Redondo Beach, both of Calif.

[73] Assignee: Farr Company, El Segundo, Calif.

[21] Appl. No.: 160,139

[22] Filed: Jun. 16, 1980

[51] Int. Cl.[3] ..... F02B 37/00; F02B 77/00

[52] U.S. Cl. ..... 60/611; 123/198 D

[58] Field of Search ..... 60/600, 601, 665, 611; 123/198 DB, 198 D

[56] References Cited

U.S. PATENT DOCUMENTS 4,129,040 12/1978 Hayden ..... 123/198 D
4,201,178 5/1980 Tyrer et al. ..... 123/198 D

FOREIGN PATENT DOCUMENTS 1907727 10/1970 Fed. Rep. of Germany ... 123/198 D
2715110 10/1977 Fed. Rep. of Germany ... 123/198 D
2399544 3/1979 France ..... 123/198 D
1277020 6/1972 United Kingdom ..... 123/198 D

*Primary Examiner*—Michael Koczo
*Attorney, Agent, or Firm*—Lyon & Lyon

[57] ABSTRACT

Disclosed herein is an emergency shutdown mechanism for a turbocharged diesel locomotive to prevent overspeeding of the turbocharger under engine malfunction conditions. The shutdown mechanism includes an air flow shutoff plate slidably mounted for selective closing of the air intake end of the turbocharger, a plurality of sensors mounted in the air box about the pistons for detecting increases of temperature and/or pressure within the air box and means activated by the sensors in response to such increases of temperature and/or pressure for moving the shutoff plate across the air intake end of the turbocharger and preventing air flow therethrough. The cessation of air flow through the turbocharger causes the engine to immediately shutdown and prevents overspeeding of the turbocharger.

10 Claims, 3 Drawing Figures

EMERGENCY SHUTDOWN MECHANISM FOR A TURBOCHARGED DIESEL ENGINE

BACKGROUND OF THE INVENTION

The majority of large locomotives in use today are powered by turbocharged diesel engines. While such engines are quite powerful yet relatively economical to operate, the life of the turbocharger used on these locomotives has proved to be quite short, about two years or less. As these turbochargers are quite expensive to replace or repair, this limitation has presented a substantial problem to the industry, a problem which has heretofore been unsolved.

The short life of the turbochargers used on these engines has been found to result frequently from overspeeding which occurs as a result of fires in the air box and exhaust manifold. The air box is the housing which extends the length and width of the diesel engine, about the crank case and a portion of the liner disposed about the engine pistons. When a fire occurs in the air box, not only can the engine be damaged, but the temperature of the exhaust gases which runs the turbocharger increases causing the rotational speed of the turbocharger to increase and overspeed. When the turbocharger overspeeds, the blades grow into the surrounding shrouds and tear, resulting in severe damage or even a total loss of the turbocharger. Fires in the exhaust manifold have the same resulting effects.

Air box fires are common and generally result from the belching of fire from the engine cylinders back through the air intake ports into the air box which ignites the oil which has accumulated therein. This oil build-up within the air box results from the cooling oil which is squirted onto the pistons and accumulates when the side vents become plugged which are designed to channel away the cooling oil into a protected oil sump. In addition, when the pistons are moving downward and the air intake ports open, combustion is still ocurring within the cylinders and the pressure within the cylinders is not totally dissipated by expansion, a snuff back results wherein the oil is blown through the ports, coating the air box around the liner. This results in highly inflammable air box interior which is easily ignited when burning fuel is also belched back through the ports into the air box. Exhaust manifold fires are usually caused by an accumulation of lube oil and fuel resulting from malfunctioning or defective valve guides or rings. As the engineer is not positioned near the air box or exhaust manifold while the engine is running, these fires are not quickly detected and the turbocharger overspeed occurs quite rapidly. Hence, the very short life of these turbochargers. In fact, even when the fires were rapidly detected, the industry has not heretofore found any means of preventing the onsuing overspeed due to its inability of finding a way immediately to shut down the locomotive engine. When the throttle is quickly closed, cutting off the normal fuel flow, these diesel engines will burn the fuel partially consumed by the fire and continue to run for a period of time sufficiently long to cause the turbocharger overspeed. As a result, the industry has continued to endure the high costs of turbocharger repair and replacement.

Another related problem is the occurrence of a fire in the electrical cabinet on the locomotive. As such fires similarly go unnoticed for a period of time, the engine continues to drive the generator which feeds the fire which can result in the destruction or severe damage of not only the electrical equipment but the engine as well. If the engine could be shutdown immediately upon the occurrence of such a fire, the generator would stop and such fires could be readily extinguished before they could cause such damage.

It would therefore be highly desirable to provide a means by which the diesel engine and turbocharger in a locomotive could be immediately shutdown upon the occurrence of a fire in either the engine or electrical equipment whereby the life of such parts as engine components, turbocharger and electrical equipment could be greatly extended. The shutdown mechanism disclosed and claimed herein has been found to be highly successful in accomplishing this purpose.

SUMMARY OF THE INVENTION

Briefly, the invention disclosed herein comprises a mechanism by which a fire in the air box, exhaust manifold or electrical equipment of a turbocharged diesel locomotive can be rapidly detected and both the turbocharger and engine rapidly shutdown before engine damage or electrical damage can occur. The mechanism includes a plurality of sensors for detecting the fire and an air flow shutoff plate activated by the sensors for cutting off the clean air flow into the turbocharger causing the turbocharger and engine immediately to shutdown.

It is therefore the principal object of this invention to provide a mechanism for quickly shutting down a turbocharged diesel engine in a locomotive and preventing overspeed of the turbocharger upon the occurrence of a fire in the engine air box, exhaust manifold or electrical equipment.

This and other objects and advantages of the present invention will become apparent from the following detailed description taken in conjunction with the accompanying drawings.

IN THE DRAWINGS

DESCRIPTION OF THE PREFERRED EMBODIMENT

Figure 1:
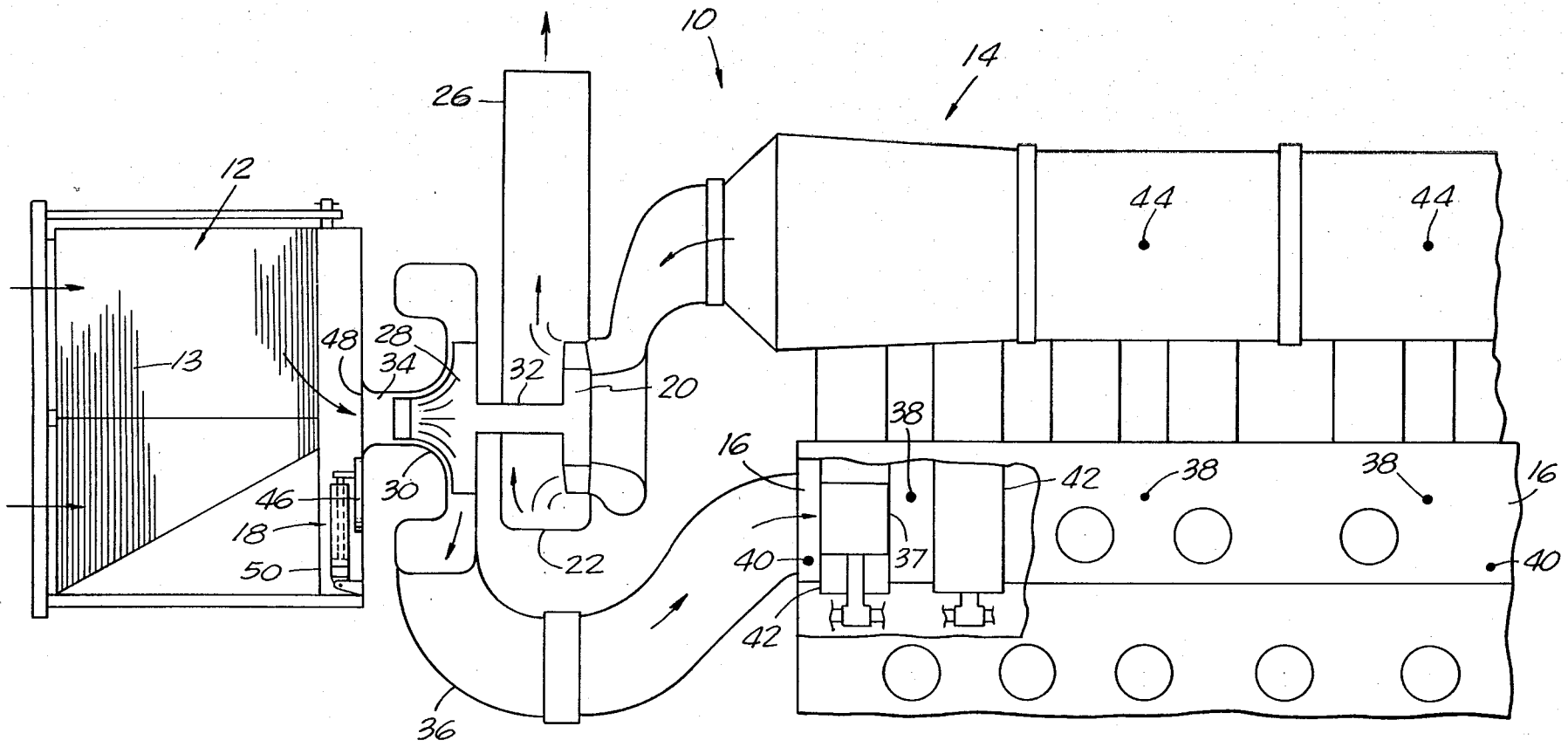
FIG. 1 is a partial schematic view of the engine turbocharger, air box and shutdown mechanism of the present invention.

Referring now in detail to the drawings, FIG. 1 illustrates schematically the locomotive diesel engine turbocharger 10 including the turbocharger air intake filter housing 12 and exhaust manifold 14 which are shown operatively connected with the diesel engine air box 16. The emergency shutdown mechanism 18 is also schematically illustrated in the air inlet filter housing 12 for the purpose of general explanation, but is shown in detail in FIGS. 2 and 3 and will be discussed in detail later herein.

As seen in FIG. 1, the turbocharger 10 receives the exhaust gases emanating from the engine through the exhaust manifold 14. These exhaust gases in the engine manifold are typically at about 1000° Fahrenheit and are directed against the turbocharger blades 20 mounted in shroud 22. These gases cause the turbocharger blades 20 to rotate rapidly and are exhausted to the atmosphere through stack 26. Blades 20 are connected to the turbocharger blades 28 mounted in shroud 30 in the compressor side of the turbocharger by a shaft 32. Corresponding rotation of blades 28 causes clean air to be drawn through the clean air inlet filter housing 12 from where it is directed through nozzle 34 into shroud 30 and compressed by the rapidly rotating blades 28. Suitable air filter elements 13 are also preferably mounted within the clean air inlet manifold housing 12 to remove foreign particles from the air entering the turbocharger. The compressed fresh air is then directed via conduit 36 to the combustion chamber within air box 16. As the air box and diesel engine are of standard configuration, they are not shown in detail in the drawings. One piston 37 is illustrated, however, for the purpose of referencing the positioning of the pressure and temperature sensors to be discussed later.

As previously discussed, when a fire occurs within the air box 16, the temperature of the exhaust gases entering the turbocharger through the exhaust manifold 14 increases causing blades 22 and 28 to rotate more rapidly and overspeed. When the blades overspeed, they will grow and form a groove in the surrounding shroud 22 and 30, tearing the blades and often resulting in a blow-up of the turbocharger, in addition, galling can occur on the engine pistons due to a lack of lubrication. The shutdown mechanism 18 prevents overspeeding of the turbocharger 10 by first quickly sensing the fire within the air box 16 by means of a plurality of temperature sensors 38 and pressure sensors 40 disposed within the air box, with the temperature sensors 38 being preferably mounted between the cylinders 42. The standard operating temperature and pressure within the air box is around 250° Fahrenheit and 24 psi. The temperature sensors 38 are preferably thermal switches which are set to open at about 280°-300° Fahrenheit while the pressure sensors are preferably of the conventional spring loaded diaphragm type which are set to trigger when the pressure within the air box reaches 28 psi. It is to be understood, of course, that other types of temperature and pressure switches could also be employed. It will be recognized by those skilled in the art that a hostile environment of elevated temperature and pressure, as well as high vibration, is presented by the diesel locomotive. Thus, the sensors selected for use should be matched to the environmental requirements of each location, since reliability is a significant requirement for the present invention. Further if it is desired, secondary temperature sensors 44 could be mounted within the exhaust manifold 14. Temperature sensors 44 would preferably be of the thermocouple or RTD type and would be set to activate at a temperature of about 1050°-1080° Fahrenheit which approximately effectuates red lining of the turbocharger at about 20,000 RPM.

In addition, temperature sensors (not shown) could also be located in the electrical cabinet of the locomotive and in the clean air inlet manifold housing 12 as well and, if desired, a tachometer sensor 45 for detecting directly overspeeding of the turbocharger could also be employed. Such additional temperature sensors in the electrical cabinet would detect the occurrence of an electrical fire, activate the shutdown mechanism in the same manner as sensors 38 and thereby shutdown the engine and generator which would otherwise continue to feed the electrical fire. As such temperature sensors operate in the same manner as do sensors 38 to activate the shutdown mechanism, the following description will refer solely to sensors 38.

Upon activation of either the temperature sensors 38 or pressure sensors 40, both of which would occur in an air box or exhaust manifold fire, an air flow shutoff plate 46 which is slidably mounted adjacent the upstream end 48 of the air nozzle 34 on the compressor side of the turbocharger is activated to cut off instantaneously the clean air flow into the turbocharger. It has been found that as soon as the air flow is cut off, the pressure in the air box drops to atmospheric in about 1.1 seconds and without any oxygen, the fire is quickly extinguished. Concurrently, the temperature and pressure in the engine exhaust drops causing the turbocharger to slow immediately and freewheel before it can overspeed and be damaged. Within about 5 seconds, the large diesel engine itself comes to a stop. This entire shutoff operation has been found to be sufficiently rapid to prevent overspeeding of the turbocharger despite the short time necessary for overspeeding to occur. Furthermore, vital engine parts are protected against overheat. In addition, an electrical fire will be extinguished, as noted above. For example, the time between the activation of the pressure and temperature sensors and the closing of the air flow to the turbocharger by plate 46 was measured at 0.3 seconds.

Figure 2:
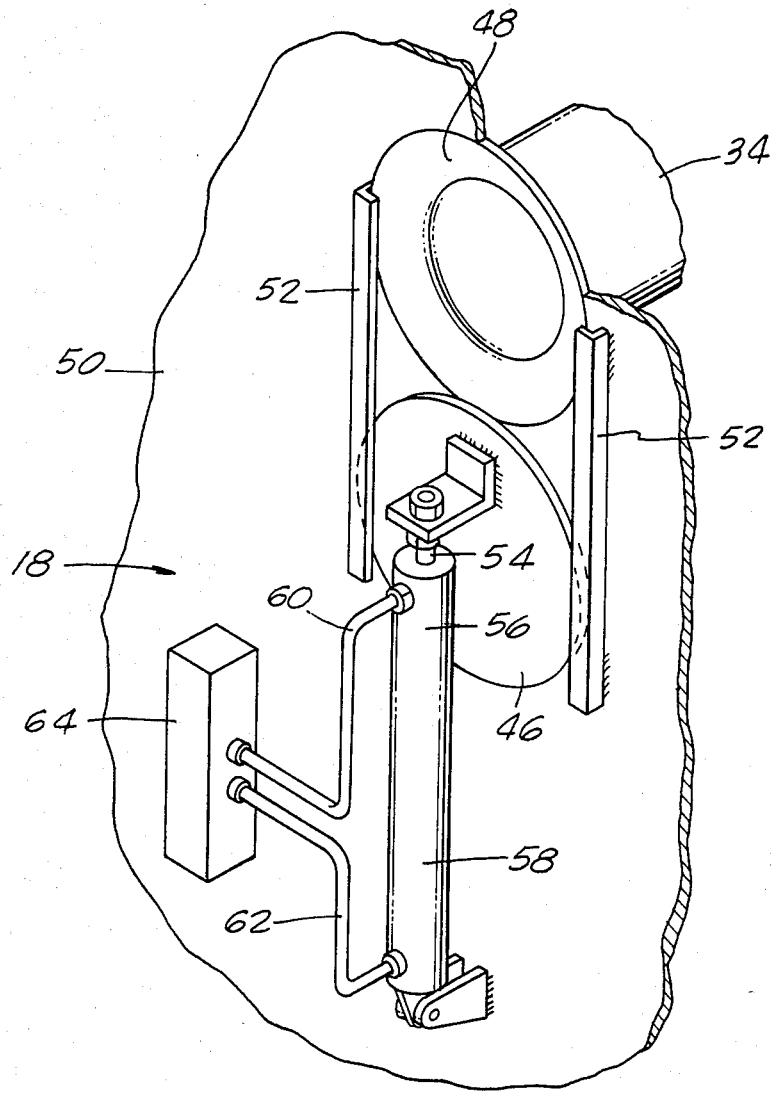
FIG. 2 is a frontal view illustrating the operative components of the shutdown mechanism of the present invention disposed across the air intake nozzle of the engine turbocharger.

As seen in FIG. 2, the slide plate 46 is slidably mounted on the downstream end plate 50 of the air inlet manifold housing 12 by runners 52 so that the plate can be slid into and out of the air flow path through nozzle 34. The plate 46 has secured thereto a ram 54 extending from end 56 of a two-way air cylinder 58, both ends of which are communicated with a source of pressurized air through lines 60 and 62 through a double solenoid activated valve 64. Upon actuation of the valve 64 in one direction, air flow is directed through line 60 causing the ram 54 rapidly to extend and move the shutoff plate 46 across the nozzle 34. Upon activating a pressure relief switch 66 (see FIG. 3) the valve 64 relieves the pressure in line 60 and pressurizes line 62 causing the shutoff plate to return to its open position for resumption of operation.

Figure 3:
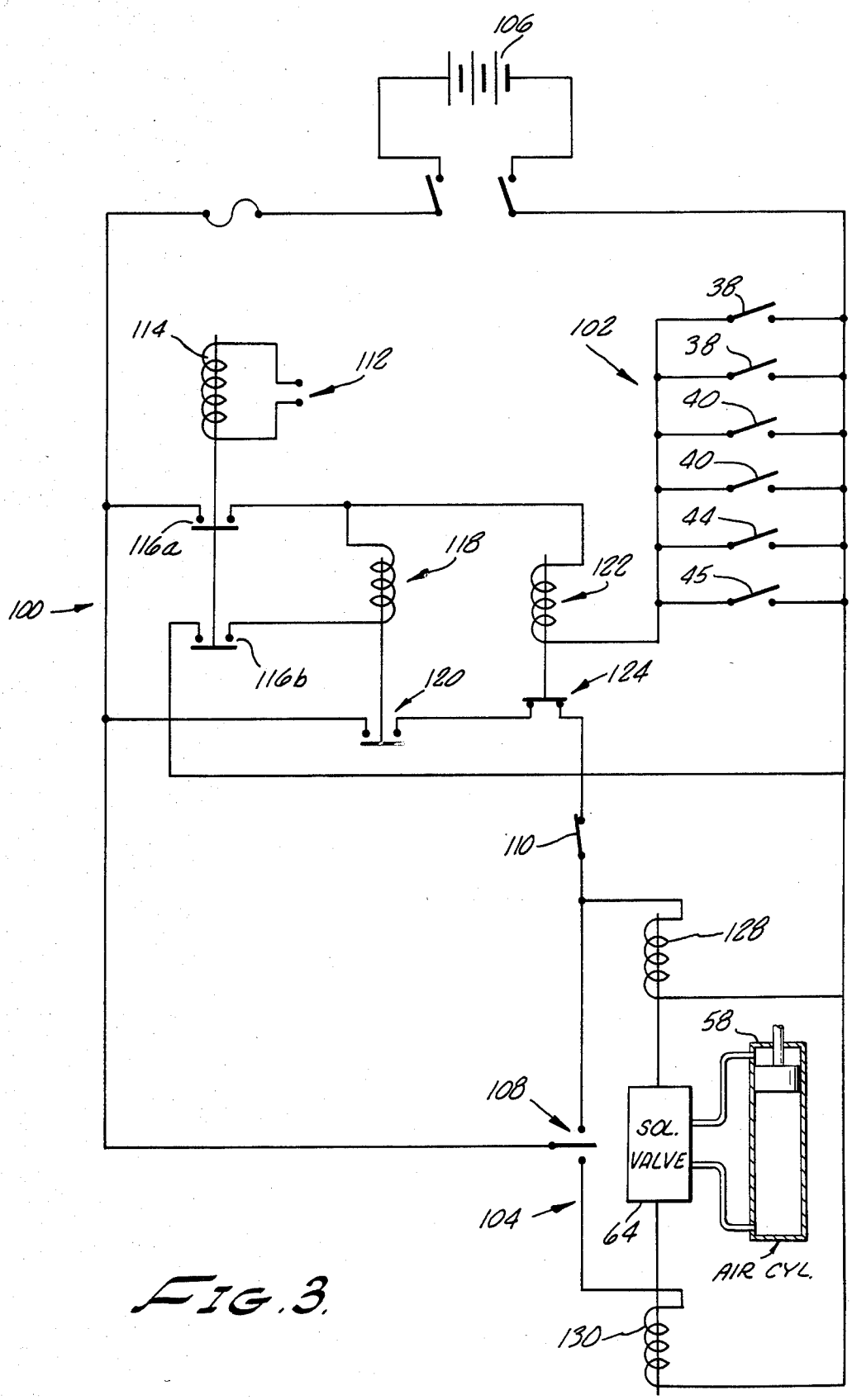
FIG. 3 is a schematic diagram illustrating an embodiment of the circuitry for the shutoff valve of the present invention.

Reference is now made to FIG. 3, which illustrates in schematic diagram form exemplary circuitry for controlling the solenoid valve 64 and associated air cylinder 58. In general, the circuitry of FIG. 3 includes a power supply section indicated generally at 100, together with a sensor section indicated generally at 102 and an actuation section indicated generally at 104. Test and manual override circuitry such as a battery 106, double throw switch 108 and disable switch 110 may be provided if desired.

In operation, a generator on the locomotive (not shown) provides power to a pair of terminals 112, which causes a solenoid coil 114 to energize. When the coil 114 energizes, two pair of normally open contacts 116*a* and 116*b* close, thereby connecting the battery 106 across the coil of a relay 118. Energizing the coil of the relay 118 causes associated, normally open contacts 120 to close. Closure of the contacts 116*a* also supplies power to one terminal of a relay 122, the remaining terminal of which is connected through the sensor section 102 to the negative terminal of the battery 106. Energization of the relay 122 opens an associated pair of normally closed contacts 124, thereby deactuating the actuation section 104 by disconnecting power therefrom. It can be seen that the relays 118 and 122 provide an interlocked power supply in cooperation with the solenoid 114.

The sensor section 102 includes a plurality of temperature sensors 38 and 44, pressure sensors 40 and a tachometer sensor 45 as discussed above. While only two temperature sensors 38 and pressure sensors 40 are shown for simplicity, it is to be understood that several sensors are preferably employed in the air box as indicated above. Similarly, more than one temperature sensor 44 in the exhaust manifold may be employed while, for simplicity, only one is illustrated in FIG. 3.

In the event any of the sensors 38 or 40 activates indicating a potentially destructive fire, the relay 122 is connected to the negative terminal of the battery 106 thereby closing the contacts 124. This permits a control coil 128 of the solenoid valve 64 to become energized, thereby extending the solenoid valve 64 and operating the air cylinder 58 as previously described. Thus, potentially destructive fires within the locomotive are rapidly detected and extinguished.

As previously noted, a testing circuit which includes the switch 108 may also be provided. The switch 108, which is operated when the disabling switch 110 disconnects the remainder of the circuit from the action section 104, permits the solenoid valve to be manually energized for either retraction or extension. Thus the double throw switch 108 may be actuated in a first direction to energize the coil 128 and thereby extend the solenoid valve 64 or the switch 108 may be actuated in the opposite direction to energize a coil 130 to cause retraction. It will be noted that the coil 130 can only be energized through the switch 108.

It should be noted that the above description relating to the circuitry illustrated in FIG. 3 is merely exemplary and different electrical and mechanical components could be employed to effectuate rapid closing of the clean air flow to the turbocharger by shutoff plate 46. It should also be noted that shutdown mechanism is not limited to use on locomotives but useful on all two-cycle turbocharged diesel engines. While various changes and modifications could be made to the present invention without departing from the spirit and scope thereof, insofar as these changes and modifications are within the purview of the appended claims they are to be considered as part of the invention.

We claim:

1. An emergency shutdown mechanism for a turbocharged two-cycle diesel engine in a locomotive for preventing overspeed of the turbocharger in the event of a fire in the engine air box disposed about the crankcase, engine cylinders and a portion of the piston liner, said mechanism comprising a first valve means operatively connected to said turbocharger for selectively, rapidly closing the clean air inlet of the turbocharger; means for actuating said first valve means; a plurality of temperature responsive sensors disposed within said air box between said cylinders for detecting an overheating condition in said air box; means operatively connected between said valve actuating means and said temperature responsive sensors for activating said actuating means upon detection of said overheating condition by said temperature responsive sensors whereby said valve means is rapidly closed by said actuating means shutting down said turbocharger and said diesel engine.

2. The combination of claim 1 wherein said valve means comprises an air flow shutoff plate slidably mounted at the clean air inlet end of said turbocharger for movement over said clean air inlet and preventing air flow therethrough and said actuating means comprising a ram secured to said plate and means for effecting rapid movement of said ram for moving said plate over said clean air inlet.

3. A combination of claim 2 wherein said means for effecting rapid movement of said ram comprises a two-way pneumatic cylinder and includes a source of pressurized air and means for selectively communicating said source of pressurized air with one end of said cylinder for imparting selective reciprocal movement to said ram whereby said shutoff plate is slidably moved over said clean air inlet for shutting down said turbocharger and said diesel engine and away from said clean air inlet for the resumption of operation of said turbocharged diesel locomotive.

4. An emergency shutdown mechanism for a turbocharged two-cycle diesel engine in a locomotive for preventing overspeed of the turbocharger in the event of a fire in the engine air box disposed about the crankcase, engine cylinders and a portion of the piston liner, or in the exhaust manifold, said mechanism comprising an air flow shutdown plate slidably mounted at the clean air inlet end of the turbocharger; means for moving said plate over said clear air inlet and preventing fluid flow therethrough; a plurality of temperature responsive sensors disposed within said air box between said cylinders for detecting an overheating condition within said air box; a pressure responsive sensor disposed within said air box for detecting fires in said air box and in said exhaust manifold; means operatively connected between said means for moving said plate and said temperature and pressure responsive sensors for activating said moving means upon detection of said overheating condition by said temperature responsive sensors or a fire by said pressure responsive sensor whereby said air flow shutdown plate is rapidly moved over said clean air inlet by said moving means shutting off the clean air flow to the turbocharger and shutting down said turbocharger and said diesel engine.

5. The method for preventing overspeed of a turbocharger in a turbocharged diesel engine in a locomotive in the event of a fire in the engine air box, said method comprising the steps of: monitoring the temperature in the engine air box adjacent the engine cylinders; detecting the rise of temperature in the engine air box adjacent the engine cylinders, signaling the rise of temperature within the engine air box; and shutting off the clean air flow to the turbocharger in response to the signal of the rise of temperature in the engine air box before overspeed of the turbocharger occurs.

6. The method set forth in claim 5 wherein the signaling of the rise of the temperature in the engine air box occurs with a rise of temperature of 30°–50° F.

7. The method for preventing overspeed of a turbocharger in a turbocharged diesel engine in a locomotive in the event of a fire in the engine air box or in the exhaust manifold, said method comprising the steps of: monitoring the temperature and pressure within the engine air box and in the exhaust manifold; detecting a rise of temperature and pressure within the engine air box, signaling the rise of temperature and pressure within the engine air box or in the exhaust manifold and shutting off the clean air flow to the turbocharger in response to a signal of a rise of pressure or temperature within the engine air box or in the exhaust manifold before overspeed of the turbocharger occurs.

8. The method set forth in claim 7 wherein the signaling of the rise of temperature within the air box occurs with a rise of about 30°–50° F. and the signaling of the rise of pressure within the engine air box occurs with a rise of pressure of about 3 psi.

9. The method set forth in claim 7 wherein the step of signaling the rise of pressure occurs with a rise of pressure in the engine air box of about 3 psi.

10. The method set forth in claim 7 wherein the step of signaling the rise of temperature in the engine air box occurs with a rise of temperature of 30°–50° F.

* * * * *